United States Patent [19]

Clabburn

[11] Patent Number: 4,865,559

[45] Date of Patent: Sep. 12, 1989

[54] HIGH VOLTAGE CONNECTOR

[75] Inventor: Robin J. Clabburn, Nr. Swindon, England

[73] Assignee: Raychem Limited, London, England

[21] Appl. No.: 222,317

[22] Filed: Jul. 19, 1988

Related U.S. Application Data

[63] Continuation of Ser. No. 45,266, Apr. 22, 1987, abandoned, which is a continuation of Ser. No. 681,339, Dec. 12, 1984, abandoned.

[30] Foreign Application Priority Data

Dec. 14, 1983 [GB] United Kingdom ..... 8333353
Apr. 18, 1984 [GB] United Kingdom ..... 8410035

[51] Int. Cl.[4] ..... H01R 13/52

[52] U.S. Cl. ..... 439/281; 439/507; 439/724; 439/921

[58] Field of Search ..... 439/181, 607, 609, 610, 439/786, 787, 788, 796, 797, 798, 507, 587, 921, 281, 364, 723, 724

[56] References Cited

U.S. PATENT DOCUMENTS

| | | | |
|---|---|---|---|
| 3,277,424 | 10/1966 | Nelson | 439/205 |
| 3,375,480 | 3/1968 | Nelson | 439/148 |
| 3,513,425 | 5/1970 | Arndt | 439/582 |
| 3,585,568 | 6/1971 | Hervig | 439/88 |
| 3,740,700 | 6/1973 | Robertson | 439/507 |
| 3,883,208 | 5/1975 | Sankey et al. | 439/101 |
| 3,924,919 | 12/1975 | McClain | 439/480 |
| 4,202,591 | 5/1980 | Borgstrom | 439/185 |
| 4,354,721 | 10/1982 | Luzzi | 439/475 |

FOREIGN PATENT DOCUMENTS

| | | |
|---|---|---|
| 087267 | 8/1983 | European Pat. Off. . |
| 092616 | 11/1983 | European Pat. Off. . |
| 500877 | 2/1939 | United Kingdom . |
| 1444767 | 8/1976 | United Kingdom . |

*Primary Examiner*—Neil Abrams
*Attorney, Agent, or Firm*—Edith A. Rice; Herbert G. Burkard

[57] ABSTRACT

A high voltage connector is provided for interconnecting a power cable to an apparatus such as a transformer. The cable is securely coupled to the connector, which is then mounted on to the transformer bushing. The bushing and cable electrical contacts inside the connector are spaced apart, and electrical connection is achieved therebetween by inserting a continuity plug into a socket of the connector. Electrical isolation between the cable and transformer may be effected without physically moving either piece of equipment, by removing the continuity plug and replacing it with another plug that introduces sufficient electrical insulation between the equipment contacts to allow operating and test voltages to be applied to one of the cable and transformer without flashover occurring to the other of said pieces of equipment. Other interchangeable plugs may provide earthing for a selected one of the pieces of equipment, also without requiring physical movement of the equipment.

41 Claims, 4 Drawing Sheets

Fig.9.
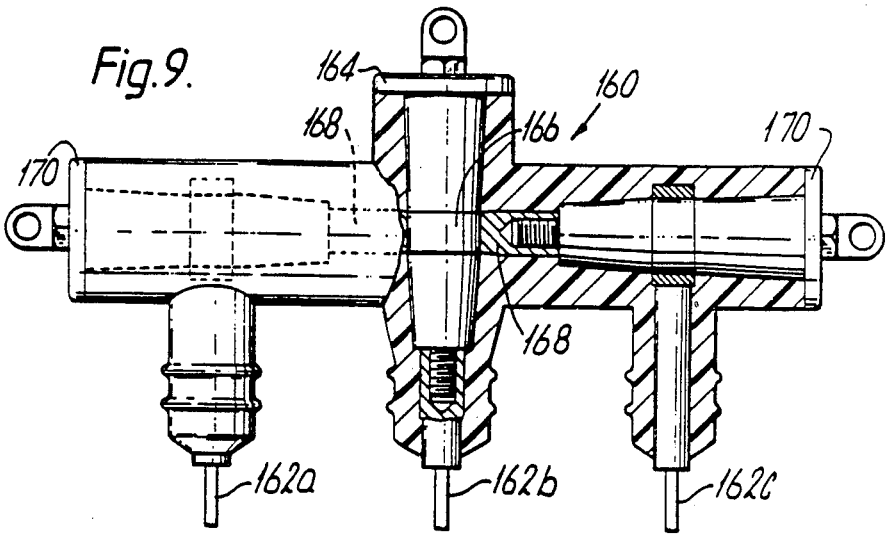
Fig.10.
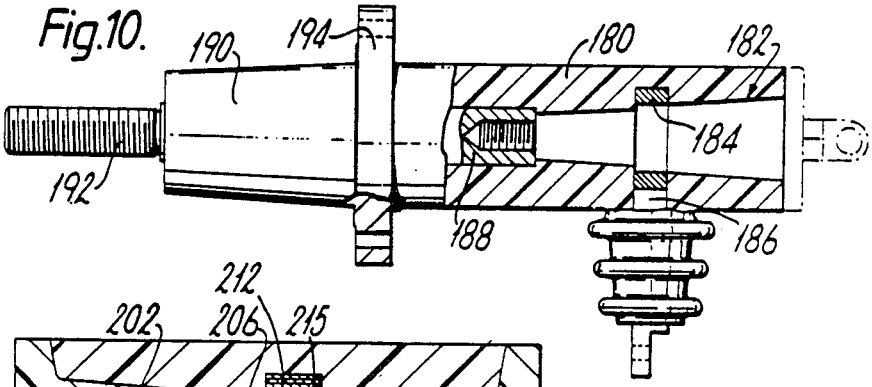
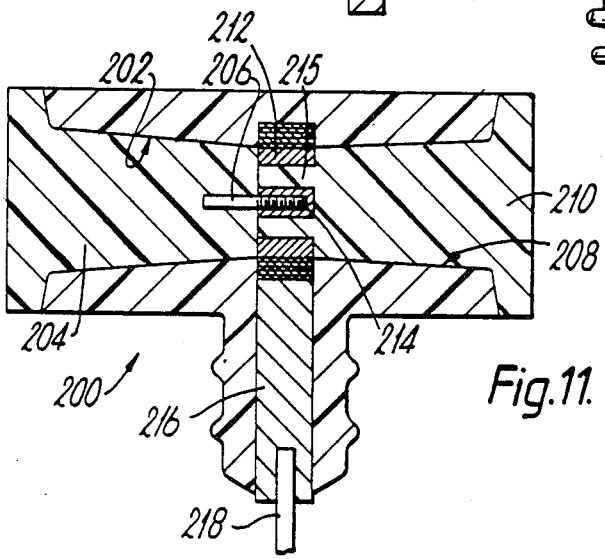
Fig.11.

HIGH VOLTAGE CONNECTOR

This application is a continuation of application Ser. No. 07/045,266 filed Apr. 22, 1987, now abandoned, which in turn is a continuation of application Ser. No. 06/681,339 filed Dec. 12, 1984, now abandoned.

DESCRIPTION

This invention relates to high voltage connectors and arrangements comprising said connectors. Particularly, though not exclusively, the connector may be an adaptor for connecting electrical equipment such as an electric power cable to a switch, switchgear, a fuse, a transformer, another cable, or to some piece of electrical equipment.

It is known to provide an inline, L-, or T- shaped adaptor to connect a high voltage cable (i.e. one rated at above about 1 kV) to a transformer, for example. The adaptor usually has one inwardly-tapering socket in one arm thereof that is a push fit on to a bushing of the transformer, and receives the stripped or terminated end of the cable in another arm aligned with or at right angles thereto. The socket has an electrical contact (male or female) for co-operating with the contact (respectively female or male) of the bushing. The cable may be a push-fit into said other arm, or it may be connected externally of the adaptor to a terminal that is moulded thereinto, as disclosed in European Patent Application Publication No. 87267. Other adaptors, usually of T-shape, have the bushing and cable arms at right angles to each other, and a further arm with a socket aligned with the bushing arm. Such further arm is closed by a removable plug that may allow access to connect the cable mechanically and electrically to the bushing.

With these known adaptors, if it is necessary to disconnect the cable from the transformer, or to test or repair the cable or the transformer, the adaptor has to be physically removed from the transformer bushing, carrying the cable with it, to ensure electrical isolation between the cable and bushing. This action can be difficult with larger diameter cables (greater than about 95 sq mm cross-section), and furthermore, can itself cause damage to the cable, especially when of paper/lead insulation. Where electrical equipment other than a cable, for example switchgear, is to be connected, it is even more difficult and inconvenient to move the pieces of equipment relative to each other.

It is one object of the present invention to provide means for overcoming the above-mentioned disadvantages.

It is a further object of the invention to provide means of interconnecting electrical equipment, whereby a variety of electrical interconnections may be obtained therebetween without significantly affecting the mechanical interconnection between the equipment.

In accordance with one aspect of the present invention, there is provided a high voltage connector suitable for electrically interconnecting two pieces of electrical equipment, the connector having an electrically insulating body with a socket leading thereinto for receiving, in use, a complementarily-shaped plug member, and an electrical contact member mounted in the insulating body and exposed to the interior of the socket at a position partway therealong for electrical connection to one of said pieces of equipment, and wherein the socket has a longitudinally-extending portion located on each side of the contact member, which portions are arranged, in use, to engage said plug member.

Preferably said engagement between the longitudinally-extending surfaces of the plug member and the socket is a sealing engagement, to exclude moisture or other contamination from the interior of the connector.

Advantageously, at least one, and preferably both, of the socket portions is of substantially frusto-conical configuration, thereby enhancing the sealing of the plug member in the socket. Although the two frusto-conical portions will be tapered in the same general direction into the connector, they need not have the same taper angle. Alternatively, one or both of the socket portions may have a generally cylindrical configuration.

A further contact member, for connection to the other piece of electrical equipment may be locatable or located at the innermost end of said socket of the connector, and is thus spaced apart from the said contact member by the inner of the two socket portions. A plug member when inserted, in use, into the connector so as to engage with said socket portions will thus extend between the two contact members of the connector. The plug member may be arranged electrically to interconnect the two pieces of equipment (hereinafter referred to as a continuity plug), and to this end may be provided with two contact portions for engaging with respective ones of said contact members, said contact portions of the plug being electrically interconnected. Advantageously, the plug contact portions and the portion therebetween are formed integrally of electrically conductive material, and the remaining portions of the plug member, including a portion for engaging the outer socket portion, may be of electrically insulating material. An alternative plug member may comprise electrically insulating material at least to the extent that said contact members of the socket are separated by insulating material when the plug member is engaged with the socket. Such a plug member (hereinafter referred to as an isolation plug) may be formed substantially entirely of insulating material. A further plug member may have one or more contact portions for engagement with a respective one only of the contact members of the connector, which contact portion or portions is in communication with the outside of the plug member. Such further plug member (hereinafter referred to as a test plug) may be used for testing one or both pieces of equipment that are interconnected by the plug member and socket.

Said further contact member of, or associated with, the connector may be part of a bushing, of a transformer, switch, or switchgear for example, on which the connector is mounted, or of which it forms an integral part, and it will thus be appreciated that with one piece of equipment connected to said further contact member, and another piece of equipment, an electric power cable for example, connected to the said contact member, electrical interconnection between the pieces of equipment may be effected by the engagement of a continuity plug into the socket, and electrical isolation or testing may be effected simply by removal of the continuity plug and insertion of the appropriate isolation or continuity plug in its place. Importantly, these changes of electrical connection can be effected completely without the need to move or disturb either of the pieces of equipment, which can thus remain physically interconnected by means of the connector.

The insertion of an isolation plug, or a test plug with insulation between the contact members of the connector, ensures that the amount of insulation is sufficient to avoid any electrical discharges taking place between the contact members, which on application of a high voltage to the equipment would be likely to occur if air were the only insulating medium therebetween. It will thus be appreciated that the length of the insulation provided by the plug member between the contact members of the socket will have a minimum value in dependence on the operating voltage of the associated equipment.

By appropriate electrical connections through the body of the plug members, the function of a test plug may be combined with that of a continuity plug or an isolation plug.

In accordance with a further aspect of the present invention, there is provided an arrangement comprising a connector in accordance with said one aspect and one or more plug members. The plug member may be a continuity plug member, an isolation plug member, or a test plug member. Although in general the plug members may be physically separate from one another, it is envisaged that two or more of these functions may be provided by a single plug member.

The connector may have a further socket leading thereinto, that opens into the said socket, for example being substantially longitudinally aligned therewith or transversely thereof. The further socket may be arranged to receive a bushing of a transformer or other piece of electrical equipment.

Advantageously, said further socket is of generally frusto-conical configuration. In one preferred embodiment such further socket is axially aligned with and opens into the smaller end of said socket that itself is of generally frusto-conical configuration and tapering in the opposite direction to said further socket. The further socket may have an electrical contact member located therein.

Said contact member of the connector advantageously extends annularly around the socket. The contact member may extend away from the socket beyond the insulating body of the connector.

One or each of the pieces of equipment to be interconnected by the plug members and connector of the invention may be an electric power cable, and especially a high voltage cable, a transformer, a switch, or switchgear, although it is envisaged that a commonly occurring interconnection will be between a cable and a transformer. Such an interconnection will now be described in further detail, by way of example. The connector may be an adaptor, of generally T-shape, having an electrically insulating body. A conductive terminal may extend along the stem of the T, and may be moulded into the body, be a push-fit, be secured therein by arranging for the stem to be of heat-shrinkable polymeric material and being heat-shrunk therearound, or by any other suitable means. One cross arm of the adaptor may have an inwardly-tapering socket for receiving as a push-fit, a complementarily-shaped bushing of the transformer, and the other cross arm may have an inwardly-tapering socket for receiving a plug member. The plug member may, at least in part, be of generally frusto-conical configuration of insulating plastics material, and one of said contact portions thereof may provide, or be part of, an inner end face, with the other contact portion extending annularly around the curved surface of the plug member. Preferably, said contact areas are embedded in the insulating body of the plug member. The plug member may thus conveniently be formed by a moulding operation.

Each plug member and connector of the invention may have more than two electrical contacts so as to provide interconnection with more than two pieces of equipment. In this context, it is envisaged that by using suitable interconnecting members, two or more connectors may be interconnected. It will be appreciated that connectors that are interconnected may in practice be formed as an integral unit having the features of the connector of the invention, and having additional features that allow interconnection between more than two pieces of electrical equipment. For example, each of two connectors may have connected thereto an electric cable, one of said connectors may be mounted on a transformer bushing, and a plug member may be introduced into the other connector, pass therethrough and engage said one connector. Thus, by use of appropriate plug members with suitably positioned contact portions, any required electrical connection or isolation between the two cables and the transformer may be achieved.

In another advantageous embodiment, the connector may be provided with a contact member located partway along said socket thereof, with the contact member extending through the insulating body of the connector and being exposed to another socket of the connector to provide a further contact member, in the other socket.

Contact members of the connector may extend out of the insulating body to provide external terminals for the connection thereto of electrical equipment, such as electric cables. Conveniently, such a terminal may be apertured so as to receive a bolt that also passes through a lug crimped on to the conductor of the cable. Thus, the cable may be securely connected, mechanically and electrically, to the terminal, and thus to the contact member of the connector. The cable may be electrically terminated in any convenient manner, for example using an appropriate Raychem heat-shrinkable termination kit. The bolt connection of the cable on to the connector terminal may conveniently be protected by heat-shrinkable tubing.

Some, or all of the contacts of the plug members and of the connector may be spaced apart from each other in a longitudinal or in a radial direction.

In accordance with a still further aspect of the present invention, there is provided a high voltage arrangement suitable interconnecting two pieces of electrical equipment, the arrangement comprising a connector and a plug member, wherein the connector has (i) an electrically insulating body with a socket leading thereinto for receiving the plug member, and (ii) an electrical contact member mounted in the insulating body for electrical connection to one of said pieces of equipment, wherein the contact member is exposed to the interior of the socket at or towards the inner end of the socket; and wherein the plug member (i) is complementarily-shaped so as to be received in sealing engagement within the socket, and (ii) has an end portion that, on said sealing engagement, is disposed radially inwardly of the contact member, said end portion comprising an outer electrical contact portion for contacting the connector contact member, and a radially inner electric contact portion for electrical connection to the other of said pieces of electrical equipment.

In a further embodiment, a plug member is provided integrally with a conductive terminal, for connection to an electric cable for example, and an electrical contact assembly that is moveably, for example rotatably, arranged for interconnection with an electrical contact of associated equipment, for example a terminal of a bushing, and may be so connected by means of a connector in accordance with the present invention.

The continuity plug and the connector of the invention may be arranged to operate in a deadbreak manner, that is to say, they are to be disconnected only in the absence of electrical power being supplied to the equipment which they interconnect. Alternatively, they may be arranged to operate in a loadbreak manner, that is to say, they may be disconnected whilst power is being supplied to the equipment through the connector. To the latter end, the spacing apart of the contact portions of the continuity plug by the plug insulation may be sufficiently large that on removal of the plug from the connector under load conditions any arc produced on separation of the conductive portions of the plug and equipment or socket is extinguished before it is able to extend between the conductive portions of the two pieces of equipment that are interconnected by the plug and connector. Arc extinction may be achieved by manual separation of the plug member from the connector, using a hot-stick. However, since the rate of separation of the conductive portions is very important in determining whether the arc will be extinguished, it is preferred to provide a controlled mechanical arrangement to effect loadbreak. To this end, the initial movement of the plug member to effect removal from the connector, for example by rotation, may be arranged to tension and trigger a spring mechanism that may be incorporated, for example, either into the plug member itself or into the removal tool. The spring mechanism may then ensure that release of the spring, for example on further rotation of the plug member, rapidly and consistently moves the plug member from its load-carrying position, in which the two pieces of equipment are electrically interconnected by the contact portions of the plug member, to a position in which the contact portions are sufficiently separated from the conductive portions of the equipment so that any arc is interrupted, and thus extinguished. Accordingly, complete interruption of the electrical circuit can be effected before the plug member is finally removed from the connector.

The or each plug member may be provided with indicating means, for example for use in checking whether any of the associated electrical equipment has a voltage applied thereto. Such indicating means may operate by capacitative coupling and, for example, may comprise a neon light indicator.

The plug members and/or connector of the invention may be formed from an insulating material such as epoxy resin, a high melting (or softening) point thermoplastics material such as cross-linked polyethylene, other elastomeric material, polyurethane, or themosetting material. Alternatively, the components may be formed of ceramic material, in which case additional sealing may be provided, for example by elastomeric sealing material, which may be provided as O-rings.

The connector, although containing electrically conductive material, will primarily be formed from electrically insulating material, and may be so formed from a material having good anti-tracking properties. Alternatively, the connector, whilst still being formed primarily from electrically insulating material, may be shielded; that is to say, the connector may have an outermost layer or coating that is of electrically conductive material, which may be polymeric or metal, that, in use, is arranged to be connected to earth potential.

In accordance with another aspect of the invention, there is provided a kit of parts comprising a high voltage connector suitable for electrically interconnecting two pieces of electrical equipment, a first plug member arranged to co-operate with the connector so as to effect said interconnection, and a second plug member arranged to co-operate with the connector in the place of said first plug member to effect electrical isolation between said pieces of electrical equipment, wherein the connector comprises: an electrically insulating body with a socket leading thereinto, the socket having two portions and an electrical contact member mounted within the socket intermediate said portions for connection to one of said pieces of electrical equipment; wherein each of said first and second plug members comprises electrically insulating material, and is complementarily-shaped so as to be receivable in the socket of the connector, having two surface portions arranged to effect sealing engagement with respective ones of said portions of the socket; wherein said first plug member has a first electrical contact portion disposed intermediate said surface portions thereof that is arranged to engage said electrical contact member of the connector and a second electrical contact portion at the innermost end of the plug member for engaging with a further electrical contact member located or locatable in the connector at the innermost end of the socket, said first and second electrical contact portions of said first plug member being in electrical contact with each other; and wherein said second plug member is formed of electrically insulating material such as to effect electrical isolation between said electrical contact portion and said further electrical contact portion of the socket.

The connector, or parts thereof, may be recoverable (that is shrinkable), for example heat-recoverable (heat-shrinkable).

The plug member and/or connector may be formed by any suitable process, for example moulding, or casting.

Preferably and advantageously, the or each plug member is arranged to be physically secured, as by threaded interengagement for example, to the further contact member that is located or locatable at or towards the innermost end of said socket of the connector. By this means, the pieces of equipment attached to the connector can be mechanically interconnected by which ever kind of plug member engages with the connector, with the mechanical interconnection being maintained regardless of the kind of electrical interconnection that is provided by the plug fitted to the connector at any one time. The mechanical interengagement is affected only when the plugs are actually being interchanged, and the connector may be so designed as to alleviate any disturbance. For example, one piece of equipment may be bolted to the connector, a cable connection for example, whilst another may engage therewith as a push-fit, a bushing connection for example.

Embodiments of connectors, plug members, and arrangements comprising said connectors and plug members, for connecting one or more cables to a bushing of a transformer, and for interconnecting one cable to another, and their method of operation, each in accordance with the present invention, will now be described, by way of example, with reference to the accompanying drawings in which:

FIG. 9 shows a further embodiment of the connector for connecting a transformer to a respective one or to each of two cables;

FIG. 10 shows a connector that is formed integrally with a bushing; and

FIG. 11 shows a further embodiment of the connector in engagement with a further plug member and a transformer bushing.

Although the connectors and plug members described with reference to the drawings are for connecting one or more cables to a bushing, of a transformer or switchgear for example, or for interconnecting one cable to another, it is envisaged that with minor and apparent modifications thereto where appropriate, other pieces of electrical equipment, such as fuses, in-line switches, voltage or current sensors, or fault detectors, may be interconnected, to one another or to other pieces or equipment.

Figure 1:
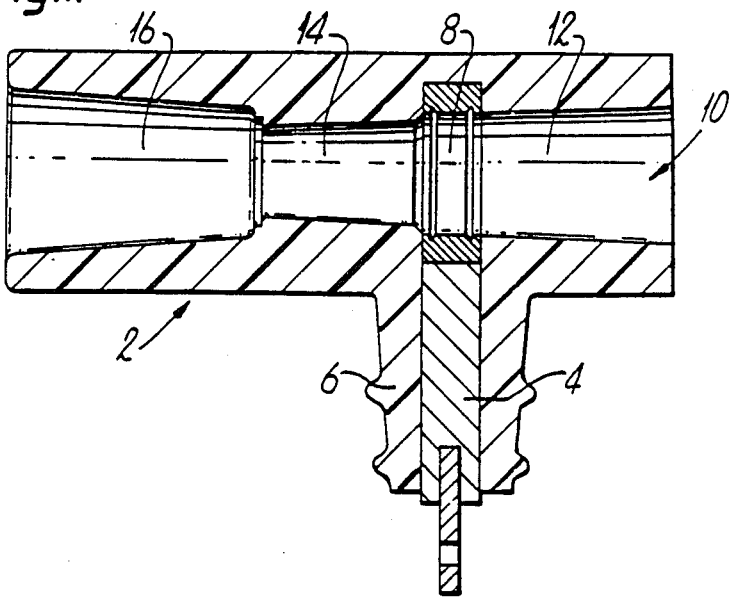
FIG. 1 shows one embodiment of the connector.

Referring to FIG. 1, the connector comprises a high voltage cable adaptor 2 moulded from insulating polymeric material. The adaptor 2 is of generally T-shape with a conductive terminal 4 secured within the stem 6 thereof. One end of the terminal 4 extends beyond the stem 6 and is apertured for connection to a lug of a cable (not shown) that is to be connected through the adaptor and an appropriate plug member to a bushing (see FIG. 5) of a transformer (not shown). The other end of terminal 4 has a multi-lam contact (i.e. a resilient contact) portion 8 which is aligned within socket 10 at a location intermediate the ends of the socket 10, such that socket 10 has a portion 12 that tapers outwardly from contact portion 8 and a portion 14 that tapers inwardly from contact portion 8. The socket portion 14 leads from the socket 10 into a second, outwardly-tapering socket 16, whose inner surface is shaped for co-operation with the outer surface of the bushing (see FIG. 5). The sockets 10 and 16 constitute the cross arm of the T-shaped adaptor.

The socket 10 is arranged to receive a plug (such as the plugs to be described with reference to FIGS. 2, 3 and 4) that is to mate with bushing that is to be received in the socket 16 (as hereinafter described with reference to FIG. 5).

Figure 2:
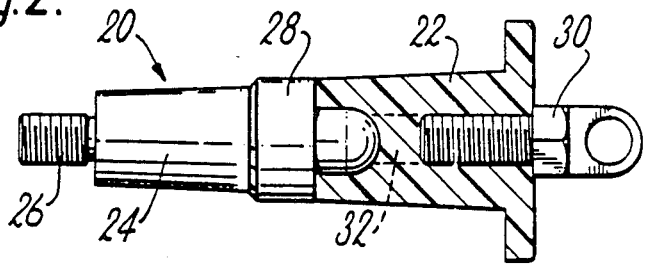
FIGS. 2, 3 and 4 show different embodiments of plug members for engaging with the connector of FIG. 1.

Referring to FIG. 2, a continuity plug 20 has an outer insulating portion 22 that is generally frusto-conical and an inner conducting portion 24 of generally frusto-conical configuration, that terminates in a threaded boss 26. Partway along the plug 20, and intermediate the two frusto-conical surface portions 22 and 24, the conducting portion 24 forms a cylindrical contact member 28. The components 24, 26 and 28 are integrally formed, from aluminium or copper. An aluminium insert 30 at the outer end of the plug 20 serves as a pulling eye by which the plug 20 may be engaged and disengaged from the connector 2, and also extends into proximity with the conducting portion 24 so as to serve as a capacitive test point therefor.

The plug 20 is arranged to be a push-fit into the socket 10 of the adaptor 2, with the plug surfaces 22 and 24 sealingly engaged with respective connector socket portions 12 and 14. When so arranged the plug contact 28 threadingly engages the bushing terminal (see FIG. 5), and the plug contact 28 mates with the cable terminal contact 8. Thus, insertion of the plug 20 with the connector 2 effects electrical connection between the physically-separated and otherwise electrically isolated cable and bushing, by means of the conductive portion of the plug 20.

The plug 20 may be modified as shown by the dotted region 32 such that the conductive portion 24 is directly connected to the metal insert 30, whereby the insert 30 can act as an external terminal of the plug. The terminal 30 may be connected to earth potential thus ensuring that the electrical equipment connected to the contacts 26 and 28 is earthed, or a test voltage may be applied thereto. Thus, when the modified plug 20 is mounted in the socket 10 of the adaptor 2, the terminal 30 may be used to earth both the cable terminal 4, and the bushing. This is particularly convenient when it is necessary to work on one or both pieces of equipment, to repair faults therein, for example.

Figure 3:
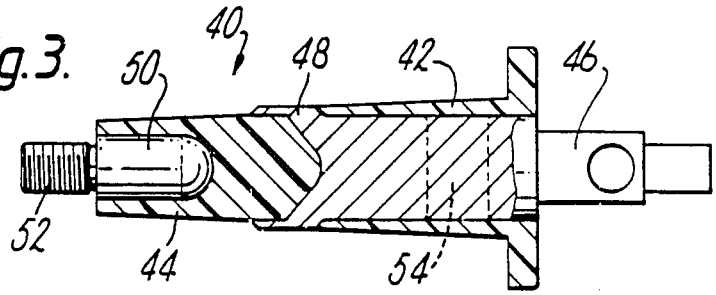

The plug 40 of FIG. 3 has the same outer configuration as the plug 20, with inner and outer generally frusto-conical insulating portions 42 and 44. A metal insert 46 extends from outside the plug to dispose an annular contact 48 intermediate the portions 42 and 44. A further metal insert 50 at the inner end of the plug disposes a threaded boss 52 therebeyond.

On engagement of the plug 40 within the socket 10 of the connector 2, the plug contact 48 engages the cable terminal 8, and the plug boss 52 again screws into the bushing to effect mechanical interconnection. However, the cable and bushing are electrically isolated by the plug portion 44, whilst the connector contact 8, and thus the equipment connected thereto, may be earthed or have a test voltage applied thereto by means of the insert 46.

On a modified form of the plug 40, the portion 54 indicated between dotted lines may be of insulating material, thus allowing for capacitive coupling between the insert 46 and contact 48, for indication purposes for example. By this latter means, it may be determined whether or not a voltage is applied to the equipment with which the contact 48 is connected.

Figure 4:
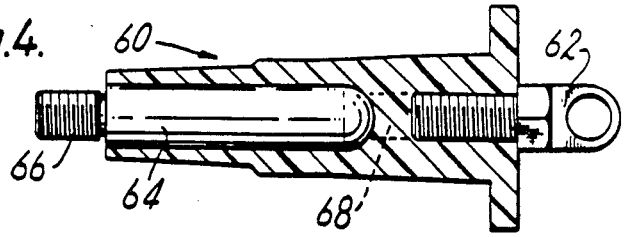

FIG. 4 shows a still further modification of plug member for co-operating with the socket 10 of the connector 2. The plug 60 of FIG. 4 has an insulating body for sealingly engaging the frusto-conical connector portions 12 and 14, and has two metal inserts 62 and 64 that are longitudinally spaced apart. Insert 62 corresponds to the inserts 30 and 46 of the plugs 20 and 40 respectively. Insert 64 disposes a boss 66 at the inner end of the plug.

On engagement of the plug 60 with the socket 10 the bushing and the cable electrically isolated at contact 8. The inserts 64 and 62 although spaced apart are capacitively coupled. An indicating means connected to insert 62 is thus capacitively coupled to insert 64.

In a modification of the plug 60, the portion 68 shown dotted may electrically interconnect, the inserts 62 and 64 for earthing or applying a test voltage to the equipment on which the bushing is mounted, whilst maintaining the electrical isolation from the cable.

Figure 5:
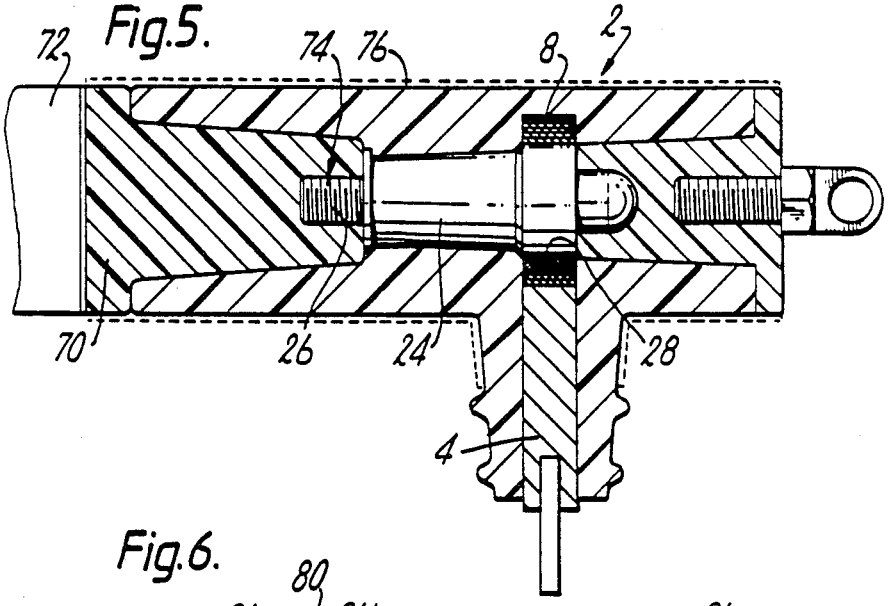
FIG. 5 shows the plug member of FIG. 2 in engagement with the connector of FIG. 1, which is mounted on a transformer bushing.

FIG. 5 shows the connector 2 mounted on a bushing 70 of electrical equipment 72, which may be a switch, and the plug 20 (FIG. 2) engaging therewith. The bushing 70 has a threaded female contact 74 that, when the connector is mounted on the bushing, is disposed at the inner ends of the socket portions 14 and 16. On threaded engagement between the plug boss 26 and the bushing contact 74, the plug 20 is sealingly fitted into the socket 10, and the plug contact 28 mates with the socket contact 8. The connector terminal 4 and the equipment, for example electric cable, attached thereto is thus connected to the other piece of equipment 72 by means of the plug conducting portions 24 and 26 and the bushing contact 74.

It will be appreciated that subsequent to mounting the adaptor 2 on the bushing 70, the plugs 20, 40 and 60 may be interchangeably mounted in the socket 12 of the adaptor 2, to interconnect or separate the cable and switch as appropriate. For each plug, its engagement with the connector provides a secure mechanical connection between the two pieces of equipment, and the plugs may be interchanged as aforesaid to achieve different electrical interconnections, including complete isolation, without having to interfere at all with the physical interconnection between the cable and switch, that is to say, without having to move the cable with respect to the switch.

The continuity plug of FIG. 2, and the isolation and/or testing plugs of FIGS. 3 and 4, each provide a male contact member, respectively 26, 52 and 66, for connecting with a female contact member 74 of the bushing. However, these roles may be reversed in an obvious manner if so desired.

The connector 2 may be screened, that is to say, provided with an outer electrically conductive coating or layer or housing that may be connected to earth potential. This is indicated by the dotted region 76, which may be provided by a metal casing, or by a conductive polymeric layer on the insulating body of the connector.

Figure 6:
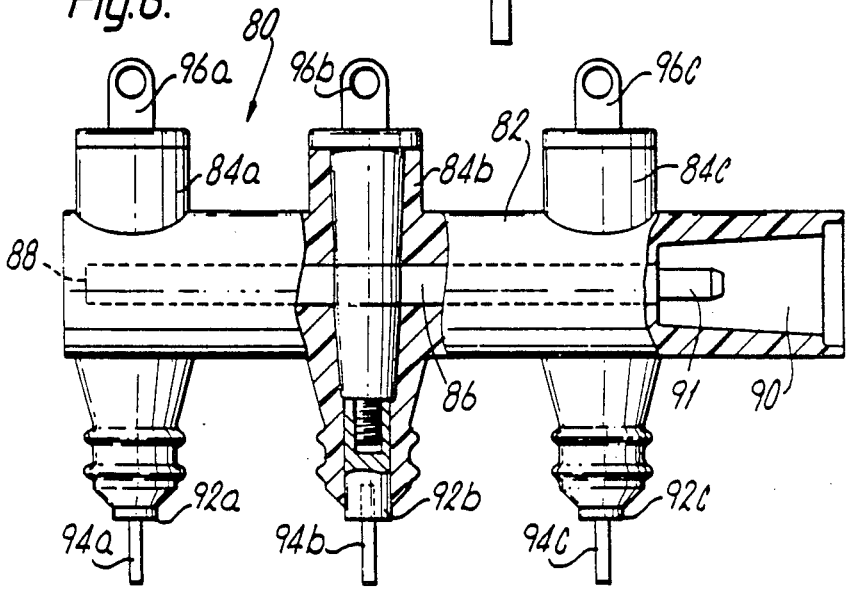
FIG. 6 shows another embodiment of the connector in engagement with three plug members for interconnecting three cables to the bushing of a transformer.

FIG. 6 shows a modified connector 80, which is arranged physically to connect three cables to one other piece of equipment, and to provide various electrical interconnections depending on the type of plugs inserted into the sockets of connector 80. Essentially, the connector 80 comprises three of the connectors 2 formed integrally with one another.

The connector 80 has a generally cylindrical portion 82 with three similar sockets 84*a*, 84*b*, 84*c* extending transversely thereof. A conductive metal rod 86 extends axially along the portion 82 and disposes an annular contact partway along each socket 84*a, b, c*. One end 88 of the connector portion 82 is closed, and the other end provides a frusto-conical socket 90 opening outwardly therefrom, and which receives a contact end 91 of the rod 86. A further contact member 92*a, b, c* is located at the ends of respective sockets 84*a, b, c*, and extends to dispose respective terminals 94*a, b, c* beyond the insulating body of the connector, for connection to respective cables in the manner described with reference to the terminal 4 of connector 2. The contact members 92*a, b, c* dispose a female contact at the inner end of respective ones of the sockets 84*a, b, c*. A plug 96*a, b, c* is inserted into respective ones of the sockets 84*a, b, c*, each plug having a threaded male contact at its inner end for engaging with a respective one of the socket contacts 92*a, b, c*. When the plugs 96*a, b, c* are continuity plugs, each has a contact member at a location intermediate the ends thereof for engaging with a respective annular contact of the axial rod 86. In such an arrangement, the plugs 96*a, b, c* connect respective terminals 94*a, b, c* to the conducting rod 86, and thus interconnect the equipment, for example, cables, connected thereto to each other and to the rod contact 91.

The connector 80 is arranged to be mounted at its socket 90 on to the bushing of, for example a transformer, which can thus supply electrical power to the three cables.

By appropriate choice of plugs 84*a, b, c*, as described with reference to FIGS. 2, 3 and 4, one or more of the cables may be isolated from each other and from the bushing, for earthing or for testing.

It will also be understood that a connector similar to the connector 80 may be formed for connecting a smaller or a larger number of cables, or other equipment, to a bushing.

Figure 7:
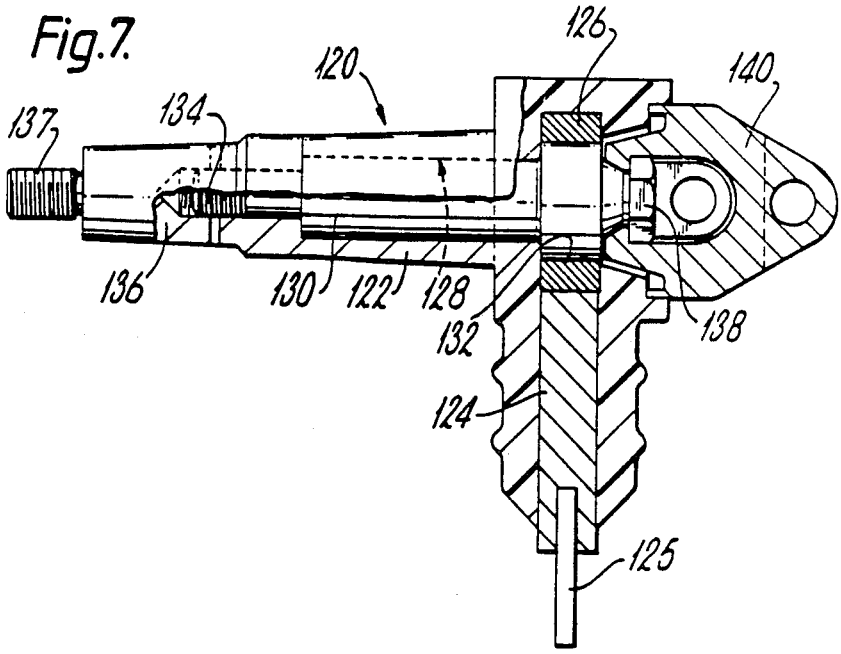
FIG. 7 shows a further embodiment of a continuity plug member.

FIG. 7 shows a further modification of a plug, wherein the electrical contact for a cable connection is formed integrally with the plug itself. The plug 120 has a generally L-shaped body 122 of insulating epoxy resin. A conductive terminal 124 is moulded into one arm of the body 122 so as to dispose a portion 125 therebeyond for connection to an electric cable (not shown). At its opposite end, the terminal 124 disposes an annular contact 126 around one end of a bore 128 that extends along the other arm of the body 122. The bore 128 has mounted therein a contact assembly 130 that comprises a generally cylindrical rod having towards one end an enlarged diameter multi-lamination contact portion 132 that engages the terminal contact 126. At its other end, the assembly 130 projects beyond the insulating body 122 as an externally-threaded stub 134. An internally-threaded metal collar 136 mates with the threaded external surface of the contact assembly 130 and abuts the end of the insulating body 122. After this engagement, the collar 136 is welded to the contact assembly 130. The collar 136 has a part-cylindrical and a part frusto-conical outer surface that terminates in an externally-threaded boss 137. The contact assembly 130 is terminated at its end remote from the collar 136 by an integral nut 138, and the bore 128 of the adaptor body 122 is closed at this end by an urethane cap 140.

The plug 120 is assembled by introducing the contact assembly 130 slidably into the bore 128 until its contact portion 132 engages with the contact 126 of the terminal 124, and the stub 134 projects beyond the housing 122. The collar 136 is then screwed on and welded in place, thus securing the assembly 130 against longitudinal movement. However, the assembly 130 is able to rotate about its axis within the bore 128, by means of rotary movement of the nut 138. This is required in order to provide mechanical connection of the plug 120 to a bushing (not shown), for example, of equipment to which the cable, which is to be attached to the terminal portion 125, is to be connected. To this end, the plug 120 may fit into, for example, the socket 10 of the adaptor 2 of FIG. 1, with electrical connection being made between the cylindrical portion of the collar 136 and the annular contact portion 8 of the terminal 4, thereby interconnecting the plug cable and the adaptor cable. The terminal pin 74 of the bushing 70 of FIG. 5 may co-operate with the threaded stub 137 of the contact assembly 130, so that rotation of the plug nut 138, rotates the assembly 130 to effect mechanical and electrical engagement of the plug 130 with the bushing 70. When this is completed, the plug cap 140 is pushed into place. It will be appreciated that the rotational movement required to complete the electrical connections between the plug 130, adaptor 2 and bushing 70 requires substantially no movement of the cables attached to the plug and adaptor.

Figure 8:
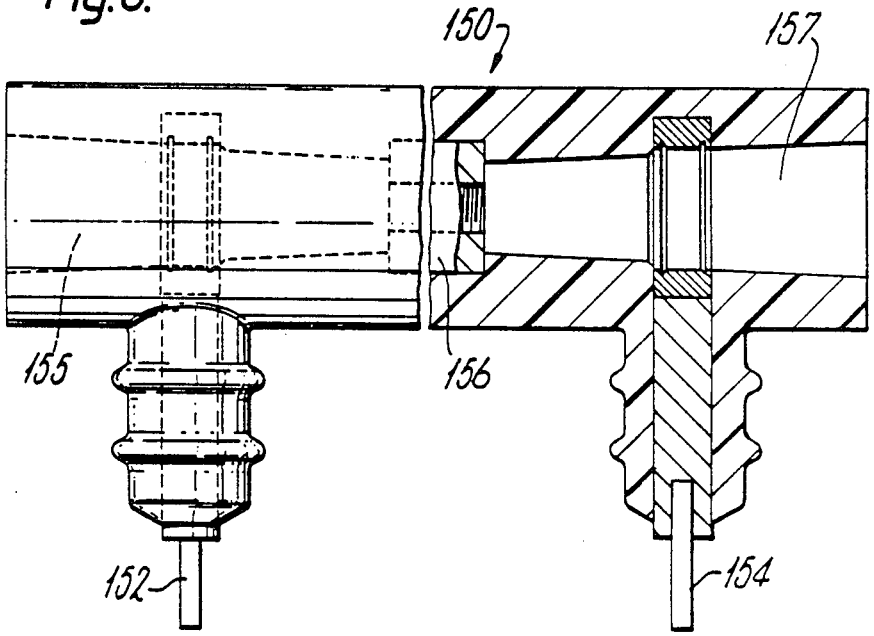
FIG. 8 shows another embodiment of the connector arranged to receive a plug member at each end thereof, whereby two cables are interconnected.

The plug 120 is particularly useful when it has a flexible cable attached to the terminal 125 thereof, and serves as a transformer connection plug. To this end, it may be used with the connector 150 of FIG. 8 whereby the power supply from the transformer through a flexible cable attached to the plug terminal 125 may be suppled directly to one or the other of the cables attached to the connector 150, by respective terminals 152, 154, by inserting the plug 120 in the appropriate side of the connector. By appropriate choice of continuity or isolating and/or testing plug to insert in the other side of the connector, the other cable may be supplied with power, earthed, or tested. As shown in FIG. 8, the socket at each side of the connector is arranged to receive the plugs 20, 40, 60, of FIGS. 2, 3, 4 respectively, and the inner ends of the sockets are interconnected by a metal cylinder 156 that disposes a female contact member therein. The cylinder 156 is moulded into the insulating body of the connector. It will be appreciated that the above-mentioned interconnections may be made without the need to move either of the pieces of equipment, for example cables, connected to the terminals 152, 154.

FIG. 9 shows a further embodiment of the connector, co-operating with three plug members to effect a variety of electrical interconnections, in dependence on the particular configuration of plugs used, between three pieces of electrical equipment attached to respective terminals thereof.

The connector 160 of FIG. 9 has three terminals **162*a*, 162*b* and 162*c* and may be arranged, for example, with a high voltage electric power cable firmly attached to respective ones of terminals 162*a* and 162*c*, and with a cable connected to terminal 162*b* providing input power from a transformer. As shown, a continuity plug 164, which may be the plug 20 of FIG. 2, is mounted in one socket of the connector 160 aligned with the transformer feed terminal 162*b*. The plug 164 passes through and forms electrical contact with an annular contact member 166 moulded into the insulating body of the connector. The contact member 166 extends transversely to each side to the plug 164 so as to dispose a further contact member 168 in each of two further connector sockets that are aligned with each other. A further continuity plug 170 is disposed in each of the further sockets. Each plug 170 is in electrical contact with an annular contact member in its own socket that is connected to a respective one of the terminals 162*a*, 162*c*. In addition, each plug is electrically connected to a respective one of the contacts 168. With the continuity plugs 170, therefore, all of the terminals 162*a*, 162*b* and 162*c* are interconnected. It will be appreciated that by replacing selected ones of the plugs 164 and 170 by appropriate isolation and/or test plugs, such as plugs 40 and 60, various combinations of interconnection, isolation and testing may be effected between the pieces of equipment connected to the terminals 162*a, b, c*. For example, power from the transformer may be supplied via terminals 162*b* and 162*a* to the cable connected to the latter cable, whilst the cable connected to terminal 162*c*** may be earthed so as to effect repair to the equipment connected thereto. Alternatively, the transformer may be isolated from each of the cables.

FIG. 10 shows a further modification, in which a connector, for interconnecting a cable and a bushing, is itself formed integrally with the bushing. Such an arrangement may thus form part of electrical equipment such as a transformer or a switch, with interchangeable plugs being fitted to the connector portion to provide electrical interconnection, isolation, testing, or earthing as appropriate. As shown in FIG. 10, the combined connector/bushing arrangement is essentially a modification of a combination of the adaptor 2 of FIG. 1 and the bushing 70 as shown in FIG. 5. Thus, the arrangement has an insulating body 180 having a two-step, inwardly-tapering socket 182. Intermediate its two tapering portions, the socket 182 has an annular contact 184 that is formed at one end of a terminal 186 whose other end projects beyond the body 180 for connection to a cable (not shown). At the end of the inner portion of the socket 182, there is disposed an internally-threaded contact member 188, that forms the terminal of the integral bushing portion 190, which extends therethrough to project at 192 beyond the insulating body 180. An apertured flange 194 is formed on the body 180, for mounting the connector securely to a wall, which may, for example, be the metal casing of a transformer. It will be appreciated that the terminal 192 will be electrically terminated within the equipment (not shown) beyond the flange 194 as appropriate. With the arrangement of FIG. 10, the transformer, or other electrical equipment, may be supplied with means for conveniently mechanically connecting a cable thereto, and may be so supplied that electrical interconnection between the cable and equipment, or separate electrical connection to one or both of such components, can be achieved simply by the insertion into the socket 182 of plugs having the appropriate electrical contact arrangements.

Such plugs may be substantially as shown in FIGS. 2, 3 and 4, and as shown a continuity plug 20 is engaged in the socket 182 and electrically interconnects the external connector terminals 186 and 192.

The connectors so far described have either integrally contained, or have been arranged to dispose therein, two electrical contact members that are spaced apart in a direction longitudinally of the socket or sockets receiving plug members or bushings received therein, in order that correspondingly longitudinally spaced-apart contact portions of plug members may effect electrical interconnection, or in order that the electrical insulation provided longitudinally of the plug members (insulating or testing or earthing plugs) is sufficient to prevent electrical breakdown between the contact members of the connector. However, it is envisaged that such contact members and contact portions may alternatively be spaced apart transversely of the socket. FIG. 11 shows diagrammatically how such interconnections may be effected. A connector 200 has a socket having a single frusto-conical portion tapering thereinto from each side thereof; a first portion 202 is arranged to receive a bushing 204 with a male threaded contact member 206 (whose rearward extension beyond the bushing 204 is not shown), and a second portion 208 is arranged to receive a plug member 210 that has an annular contact portion 212 and a female threaded contact member 214 at its inner end.

The contact portions 212 and 214 are separated radially of the plug member 210 by an annular portion 215 of the insulating body of the plug. Intermediate the socket portions 202 and 208, a contact member 216 is moulded into the insulating body of the connector 200 so as to dispose a multi-laminated one end thereof around the socket, and a terminal other end 218 beyond the connector insulation.

With the assembled arrangement shown in FIG. 11, the equipment (not shown), for example a cable, attached to the terminal 218 is mechanically connected to the equipment (not shown), for example a transformer, attached to the bushing 204, but is electrically isolated therefrom, by the plug member 210. By analogy with the plugs 20, 40, and 60 of FIGS. 2, 3 and 4 respectively, it will be appreciated that direct electrical connection between the plug portions 212 and 214 will provide a continuity plug, and connections to the axially outer end of the plug member will also for earthing and/or testing as appropriate.

It is to be understood that connectors in accordance with the invention may have configurations other than those discussed above. For example, various features may be combined from the various embodiments discussed.

As a further example, the embodiment of FIG. 8 may be modified such that the contact member 156 of FIG. 8 extends into contact with the terminal 152, and may be formed integrally therewith. The socket 155 opening towards the terminal 152 may then be closed, preferably by moulding insulation material around the combined 156 and 152 conductive member. It will thus be appreciated that insertion of a continuity plug, such as the plug 20 into the socket 157 of the connector 150 will interconnect the cables attached to respective terminals 152, 154, and that by insertion of an insulation plug or a test plug, the cables may be isolated from each other and or test voltages applied thereto.

The electrical connection of a cable on to a connector of the invention may advantageously be electrically, and mechanically, protected by heat-shrinkable sleeving that extends over the connector arm from which the connecting terminal projects. Retention of such sleeving can be enhanced by providing the connector arm with one or more external and circumferentially-extending ribs, as shown in the Figures.

Furthermore, the provision of ribs on a terminal arm of an connector can increase the creepage distance between the conductor of the cable, at high voltage, and a point at earth potential, and can also reduce the likelihood of flashover.

It will thus be appreciated that with connectors and plug members in accordance with the present invention, having appropriately positioned contact and insulating portions, required combinations of electrical interconnection and isolation can very conveniently be achieved between two or more pieces of electrical equipment. Such combinations may be achieved simply by interchanging one plug member for another, without having to disturb the pieces of electrical equipment. This is particularly advantageous where the equipment is bulky and/or rigid, and finds particular, though not exclusive, application in respect of large diameter, heavy, rigid, power cables, especially paper/lead cables, that are very difficult to move.

It is also seen that the connector provided by the present invention ensures that two electrical contact members of the connector, which in use are connected to respective pieces of electrical equipment, are separated to such an extent that with suitable choice of co-operating plug member, the contact members can not only be electrically interconnected to complete an electric circuit therebetween, but can also be electrically isolated from one another such that one piece of equipment may have an operating, or even higher test, voltage applied thereto whilst the other piece of equipment may be maintained at a significantly different potential, for example earth potential. Such change in the kind of electrical interconnection between the pieces of equipment may be made very quickly and conveniently, and without moving the equipment. It is also seen that different embodiments of the connector of the invention may be used in association with more than two pieces of electrical equipment.

I Claim:

1. A high voltage electrical connecting arrangement arranged to interconnect two pieces of electrical equipment each having electrical contact means, said arrangement comprising:

(a) a connector comprising (i) an electrically insulating body having a first and a second socket each having a respective open outer end, said sockets being axially aligned with each other and tapering inwardly towards each other from said outer ends to meet at a common inner region, a first of said sockets being arranged to receive a complimentarily-shaped portion of one of said pieces of electrical equipment, so as to expose the electrical contact means of said one piece of electrical equipment to said common inner region of said sockets; and (ii) an elongated electrical terminal having a first and a second end and mounted in said electrically insulating body generally transversely to the axis of said sockets so as to expose said first terminal end to said second socket at a location spaced apart from said common inner region intermediate said common inner region and said outer region of said second socket and to dispose the second end of said terminal outside said insulating body for connection, in use, to the other of said pieces of electrical equipment; and (b) a plug member arranged to be engageable with said second socket so as to extend from said outer end of said second socket, inwardly beyond said first end of said elongated electrical terminal, to said common inner region of said sockets.

2. An arrangement as claimed in claim 1, in which said plug member is arranged to be sealingly engaged with said insulating body along substantially the entire length of said second socket.

3. An arrangement as claimed in claim 1, in which said first end of said elongated terminal of said connector is of annular configuration and extends around an inner surface of said second socket so as to receive said plug member therethrough.

4. An arrangement as claimed in claim 1, in which said elongated terminal is integrally moulded into said electrically insulating body of said connector.

5. An arrangement as claimed in claim 1, in which said plug member is arranged, in use, electrically to interconnect said one piece of electrical equipment and said elongated electrical terminal.

6. A high voltage electrical connecting arrangement arranged to interconnect two pieces of electrical equipment each having electrical contact means, said arrangement comprising:

(a) a connector comprising (i) an electrically insulating body having a first and second socket each having a respective open outer end, said sockets being axially aligned with each other and tapering inwardly towards each other from said outer ends to meet at a common inner region, a first of said sockets being arranged to receive a complementarily-shaped portion of one of said pieces of electrical equipment, so as to expose the electrical contact means of said one piece of electrical equipment to said common inner region of said sockets; and (ii) an elongated electrical terminal having a first and second end and mounted in said electrically insulating body generally transversely to the axis of said sockets so as to expose said first terminal end to said second socket at a location spaced apart from said common inner region intermediate said common inner region and said outer end of said second socket and to dispose the second end of said terminal outside said insulating body for connection, in use, to the other of said pieces of electrical equipment; and (b) a plug member arranged to be engageable with said second socket so as to extend from said outer end of said second socket, inwardly beyond said first end of said elongated electrical terminal, to said common inner region of said sockets, said plug member comprising electrical insulation material arranged to electrically isolate said one piece of electrical equipment from said elongated electrical terminal when, in use, said one piece of equipment and said plug member engage their respective sockets.

7. An arrangement as claimed in claim 6, in which said plug member comprises electrical contact means disposed so as to be accessible from outside said insulating body when, in use, said plug member is engaged with said second socket, and in which said contact means of said plug member is in electrical communication with one or the other of said elongated electrical terminal and said electrical contact means of said one piece of electrical equipment, when said plug member and said one piece of electrical equipment are, in use, engaged with respective sockets of said insulating body.

8. An arrangement as claimed in claim 6, in which said plug member substantially fills the entire volume of said second socket.

9. An arrangement as claimed in claim 1, in which an electrically conductive member is mounted within said insulating body at said common inner region of said two sockets, said member being arranged to provide electrical interconnection between said one of said pieces of electrical equipment and said plug member.

10. A high voltage electrical connecting arrangement, arranged to interconnect two pieces of electrical equipment, said arrangement comprising:

(a) an integral electrically insulating body having a socket that has inner and outer ends and that tapers inwardly thereinto from said outer end that is open at an outer surface of said body, to said inner end of said socket within said insulating body;

(b) a first elongated electrical terminal having a first end and a second end, said first end closing said inner end of said socket and extending through said insulating body to dispose the second end of said terminal outside said insulating body for connection thereto of one of said pieces of electrical equipment;

(c) a second elongated electrical terminal having a first and a second end and mounted in said electrically insulating body generally transversely to said socket so as to expose said first end of said second terminal to the outside of said insulating body for connection, in use, to the other of said pieces of electrical equipment, and so as to expose the second end of said second terminal to said socket at a location intermediate said inner and outer ends of said socket, whereby said second end of said second terminal and said first end of said first terminal are spaced apart along said tapered socket of said insulating body; and (d) a plug member that is arranged to be engaged with said socket so as to extend from said outer end of the socket, beyond said second end of said second terminal, to said inner end of said socket.

11. An arrangement as claimed in claim 10, in which said plug member is arranged to be sealingly engaged with said insulating body along substantially the entire length of said socket.

12. An arrangement as claimed in claim 10, in which at least one of said elongated terminals is integrally moulded into said electrically insulating body of said connector.

13. A high voltage electrical connecting arrangement, arranged to interconnect two pieces of electrical equipment, said arrangement comprising:

(a) an integral electrically insulating body having a socket that has inner and outer ends and that tapers inwardly thereinto from said outer end that is open at an outer surface of said body, to said inner end of said socket within said insulating body;

(b) a first elongated electrical terminal having a first end and a second end, said first end blocking said inner end of said socket and extending through said insulating body to dispose the second end of said terminal outside said insulating body for connection thereto of one of said pieces of electrical equipment;

(c) a second elongated electrical terminal having a first and a second end and mounted in said electrically insulating body generally transversely to said socket so as to expose said first end of said second terminal to the outside of said insulating body for connection, in use, to the other of said pieces of electrical equipment, and so as to expose the second end of said second terminal to said socket at a location intermediate said inner and outer ends of said socket, whereby said second end of said second terminal and said first end of said first terminal are spaced apart along said tapered socket of said insulating body; and (d) a plug member that is arranged to be engaged with said socket so as to extend from said outer end of the socket, beyond said second end of said second terminal, to said inner end of said socket, said plug member comprising electrical insulation material arranged to electrically isolate said first elongated terminal from said second elongated terminal when said plug member engages said socket.

14. An arrangement as claimed in claim 13, is which said plug member comprises electrical contact means disposed so as to be accessible from outside said insulating body when, in use, said plug member is engaged with said socket, and in which said contact member is in electrical communication with one or the other of said elongated electrical terminals.

15. An arrangement as claimed in claim 13, in which said plug member substantially fills the entire volume of said socket.

16. A high voltage electrical connecting arrangement arranged to interconnect three pieces of electrical equipment, said arrangement comprising (i) an electrically insulating body having three inwardly-tapering sockets extending thereinto from respective openings in the outer surface thereof;

(ii) three elongated electrical terminals each having an inner and outer end and each extending into said body from outside thereof to dispose its inner end within a respective one of said sockets, with its outer end being arranged for connection to one of said pieces of electrical equipment;

(iii) electrically conductive means mounted within said insulating body and exposed to each of said sockets at a position along the respective tapers thereof spaced apart from the inner ends of said terminals; and (iv) three plug members each arranged to be engageable with a respective one of said sockets to interconnect said electrically conductive means exposed to said socket with the terminal disposed within said socket.

17. An arrangement as claimed in claim 16, in which said electrically conductive means provides an annular contact member for each of said sockets.

18. An arrangement as claimed in claim 16, in which said insulating body has a further socket tapering inwardly thereinto, and in which said conductive means is exposed to said further socket for engaging with a further piece of electrical equipment that, in use, is received in said further socket.

19. A high voltage electrical connecting arrangement arranged to interconnect two pieces of electrical equipment, said arrangement comprising (a) a connector having (i) an insulating body having a first and a second socket, each having a respective open outer end, said sockets tapering inwardly of the body from said outer ends, the first of said sockets being arranged to receive a complimentarily-shaped portion of one of said pieces of electrical equipment;

(ii) a first electrical terminal mounted in said body and arranged to extend between each of said sockets so as to dispose a first portion thereof in the first of said sockets and a second portion thereof in the second of said sockets;

(iii) a second, elongated electrical terminal having a first and a second end, said second terminal being mounted in said body arranged to dispose said first end thereof in the second of said sockets spaced apart from the second portion of said first electrical terminal disposed in said second socket and said second end thereof outside said insulating body for connection thereto of another of said pieces of electrical equipment; and (b) a plug member arranged to be engageable with said second socket so to engage each of said first electrical terminal and said first end of said second electrical terminal.

20. An arrangement as claimed in claim 19, in which said sockets extend substantially perpendicularly to each other.

21. An arrangement as claimed in claim 19, in which said plug member is arranged to be sealingly engaged with said insulating body along substantially the entire length of said second socket.

22. An arrangement as claimed in claim 19, in which at least one of said terminals is integrally moulded into said electrically insulating body of said connector.

23. An arrangement as claimed in claim 19, in which said plug member is arranged, in use, electrically to interconnect said first and second electrical terminal.

24. A high voltage electrical connecting arrangement arranged to interconnect two pieces of electrical equipment, said arrangement comprising (a) a connector having (i) an insulating body having a first and a second socket each having a respective open outer end, said sockets tapering inwardly on the body from said outer ends, the first of said sockets being arranged to receive a complimentarily-shaped portion of one of said pieces of electrical equipment;

(ii) a first electrical terminal mounted in said body and arranged to extend between each of said sockets so as to dispose a first portion thereof in the first of said sockets and a second portion thereof in the second of said sockets;

(iii) a second, elongated electrical terminal having a first and a second end, said second terminal being mounted in said body arranged to dispose said first end thereof in the second of said sockets spaced apart from the second portion of said first electrical terminal disposed in said second socket and said second end thereof outside said insulating body for connection thereto of another of said pieces of electrical equipment; and (b) a plug member arranged to be engageable with said second socket so to engage each of said first electrical terminal and said first end of said second electrical terminal, said plug member comprising electrical insulation material arranged to electrically isolate said one piece of electrical equipment from said second elongated electrical terminal when, in use, said one piece of equipment and said plug member engage their respective sockets.

25. An arrangement as claimed in claim 24, in which said plug member comprises electrical contact means disposed so as to be accessible from outside said insulating body when, in use, said plug member is engaged with said second socket, and in which said contact means is in electrical communication with one or the other of said first and second electrical terminals.

26. An arrangement as claimed in claim 24, in which said plug member substantially fills the entire volume of said second socket.

27. An arrangement as claimed in claim 1 in which said plug member comprises electrical contact means disposed so as to be accessible from outside said insulating body when, in use, said plug member is engaged with said second socket, and in which said contact means is in electrical communication with one or the other of said elongated electrical terminal and said electrical contact means of said one piece of electrical equipment, when said plug member and said one piece of electrical equipment are, in use, engaged with respective sockets of said insulating body.

28. An arrangement as claimed in claim 1 in which said plug member substantially fills the entire volume of said second socket.

29. An arrangement as claimed in claim 10, in which said plug member comprises electrical contact means disposed so as to be accessible from outside said insulating body when, in use, said plug member is engaged with said socket, and in which said contact means is in electrical communication with one or the other of said elongated electrical terminals.

30. An arrangement as claimed in claim 10, in which said plug member substantially fills the entire volume of said socket.

31. An arrangement as claimed in claim 19, in which said plug member comprises electrical contact means disposed so as to be accessible from outside said insulating body when, in use, said plug member is engaged with said second socket, and in which said contact means is in electrical communication with one or the other of said first and second electrical terminals.

32. An arrangement as claimed in claim 19, in which said plug member substantially fills the entire volume of said second socket.

33. An arrangement as claimed in claim 10, in which said plug member is arranged to electrically interconnect said first end of said first elongated electrical terminal and said second end of said second electrical terminal.

34. An arrangement as claimed in claim 6, in which each of said plug members is arranged to substantially fill the entire volume of its respective socket.

35. An arrangement as claimed in claim 6, in which each of said plug members is arranged to be sealingly engaged with said electrically insulating body along substantially the entire length of its respective socket.

36. A high voltage electrical connecting arrangement arranged to interconnect three pieces of electrical equipment, said arrangement comprising:

(i) an electrically insulating body having three inwardly-tapering elongated sockets extending thereinto from respective openings in the outer surface thereof, the sockets extending substantially parallel to each other;

(ii) three elongated electrical terminals, each having an inner and outer end and each extending into said body from outside thereof to dispose its inner end within a respective one of said sockets, with its outer end being arranged for connection to one of said pieces of electrical equipment;

(iii) electrically conductive means mounted within said insulating body and exposed to each of said sockets at a position along the respective tapers thereof spaced apart from the inner ends of said terminals; and (iv) three plug members each arranged to be engageable with a respective one of said sockets so as to extend from said outer end of the socket, inwardly beyond said electrically conductive means to said inner end of a respective one of said elongated electrical terminals.

37. A high voltage electrical connecting arrangement arranged to interconnect three pieces of electrical equipment, said arrangement comprising:

(i) an electrically insulating body having three inwardly-tapering sockets extending thereinto from respective openings in the outer surface thereof;

(ii) three elongated electrical terminals each having an inner and outer end and each extending into said body from outside thereof to dispose its inner end within a respective one of said sockets, with its outer end being arranged for connection to one of said pieces of electrical equipment;

(iii) electrically conductive means mounted within said insulating body and exposed to each of said sockets at a position spaced apart along each socket form a respective one of said elongated electrical terminals; and (iv) three plug members each arranged to be engageable with a respective one of said sockets so as to extend from said outer end of the socket inwardly to said inner end of the socket.

38. An arrangement as claimed in claim 36 or claim 37, in which each of said plug members is arranged to substantially fill the entire volume of its respective socket.

39. An arrangement as claimed in claim 36 or claim 37, in which each of said plug members is arranged to be sealingly engaged with said electrically insulating body along substantially the entire length of its respective socket.

40. An arrangement as claimed in claim 37, in which said electrically conductive means is exposed at said inner end of at least one of said sockets and is exposed part way along the length of at least another of said sockets.

41. An arrangement as claimed in claim 37 or claim 40, in which one of said sockets extends substantially at right angles to another of said sockets.

* * * * *